US011299381B2

(12) United States Patent
Suh

(10) Patent No.: US 11,299,381 B2
(45) Date of Patent: Apr. 12, 2022

(54) WINCH HANDLE OPERATED BOTTLE CLOSURES AND METHODS FOR USING

(71) Applicant: Yang Suh, Honolulu, HI (US)

(72) Inventor: Yang Suh, Honolulu, HI (US)

( * ) Notice: Subject to any disclaimer, the term of this patent is extended or adjusted under 35 U.S.C. 154(b) by 213 days.

(21) Appl. No.: 16/745,330

(22) Filed: Jan. 16, 2020

(65) Prior Publication Data

US 2020/0180926 A1 Jun. 11, 2020

Related U.S. Application Data

(63) Continuation-in-part of application No. 15/439,959, filed on Feb. 23, 2017, now abandoned.

(60) Provisional application No. 62/304,947, filed on Mar. 8, 2016.

(51) Int. Cl.

| | |
|---|---|
| ***B67B 3/00*** | (2006.01) |
| ***B67B 3/20*** | (2006.01) |
| ***B67B 7/18*** | (2006.01) |
| ***B65D 41/04*** | (2006.01) |

(52) U.S. Cl.
CPC ..... *B67B 3/2006* (2013.01); *B65D 41/0485* (2013.01); *B67B 3/2066* (2013.01); *B67B 7/18* (2013.01); *B65D 2251/20* (2013.01)

(58) Field of Classification Search
CPC .... B65D 50/041; B65D 50/068; B65D 51/44; B65D 41/0485
USPC ..... 215/215
See application file for complete search history.

(56) References Cited

U.S. PATENT DOCUMENTS

| | | | | |
|---|---|---|---|---|
| 1,222,780 | A | 4/1917 | McElroy | |
| 3,865,500 | A * | 2/1975 | Newell | F16D 1/104 403/359.5 |
| 4,338,827 | A * | 7/1982 | Hooker | G05G 1/085 74/545 |
| 5,255,573 | A * | 10/1993 | Estabrook | B66D 1/7468 384/543 |
| 5,509,327 | A * | 4/1996 | Cropley | B66D 1/7468 74/545 |
| 6,491,285 | B1 * | 12/2002 | Tomita | B66D 1/7473 16/422 |
| 8,011,276 | B2 | 9/2011 | Varme | |
| 8,794,465 | B2 | 8/2014 | Okoniewski | |
| 2003/0075521 | A1 * | 4/2003 | Miura | B65D 23/102 215/384 |
| 2005/0013742 | A1 | 1/2005 | Shaw | |
| 2010/0012908 | A1 * | 1/2010 | Sjostedt | G05G 1/085 254/266 |

(Continued)

FOREIGN PATENT DOCUMENTS

| | | | |
|---|---|---|---|
| EP | 0 687 635 A1 | 12/1995 | |
| EP | 0687635 A1 * | 12/1995 | B65D 50/068 |

*Primary Examiner* — Eyamindae C Jallow
(74) *Attorney, Agent, or Firm* — Seth. M Reiss, AAL, ALLLC; Seth M. Reiss

(57) ABSTRACT

Novel closures for bottles comprising a bottle closure having a socket shaped and sized to receive the drive head of a convention winch handle and a closure means for securing the closure to the neck of the bottle to seal the bottle. Two such closures are described, one of for use with beer style bottle and another for rum or whiskey style bottles. The closures are particularly useful for bottled beverages brought aboard sailboats that use manual winches. The closures can be removed from the bottles using winch handles that are already aboard the sailboat, allowing the beverages to be consumed.

11 Claims, 5 Drawing Sheets

(56) References Cited

U.S. PATENT DOCUMENTS

| | | | | |
|---|---|---|---|---|
| 2014/0110369 | A1* | 4/2014 | Laib | B65D 23/106<br>215/40 |
| 2014/0326695 | A1* | 11/2014 | Paredes | B65D 1/0223<br>215/382 |

* cited by examiner

WINCH HANDLE OPERATED BOTTLE CLOSURES AND METHODS FOR USING

CROSS-REFERENCE TO RELATED APPLICATIONS

This U.S. Non-Provisional Utility Patent Application is a continuation-in-part application claiming the benefit, under 356 U.S.C. § 120, of nonprovisional application Ser. No. 15/439,959 filed Feb. 23, 2017 entitled Winch Handle Bottle Caps and Methods for Making and Using which, in turn, claims the benefit, under 35 U.S.C. § 119, of United States Provisional Patent Application Ser. No. 62/304,947 filed Mar. 8, 2016, both by the present inventor, the contents of both of which are incorporated herein in their entireties.

STATEMENT REGARDING FEDERALLY SPONSORED RESEARCH OR DEVELOPMENT

No government funding was used in the conception, development or reduction to practice of this invention.

FIELD OF THE INVENTION

The invention relates to closures for bottles and other containers. More specifically, this invention describes bottle closures that are opened by a conventional winch handle and methods for using said bottle closures.

BACKGROUND OF THE INVENTION

A winch or capstan is a mechanical device used to pull in (tighten) or let out (loosen) or otherwise adjust the "tension" of a rope or wire. In its simplest form it consists of a spool and attached hand crank. Winches can be found in machines as diverse as tow trucks, steam shovels and elevators. More elaborate designs have gear assemblies and can be powered by electric, hydraulic, pneumatic or internal combustion drives. Some may include a solenoid brake and/or a mechanical brake or ratchet and pawl device that prevents it from unwinding unless the pawl is retracted.

Winches are most common, and almost universally found on sailing vessels apart from small sailboats. Sailboat winches are used to tension the lines of the sailboat that include halyards, the lines used to hoist and lower the sails, and sheets, the lines used to tighten or trim the sails while underway. As such, winches are essential to the proper operation of most sailboats.

Apart from very large sailboats where the winches may be mechanically powered, the winches on small and medium sized sailboats are operated manually through the use of a winch handle or crank. Winch cranks consist of an arm, a rotating grasp or handle that extends perpendicular from one end of the crank arm, and a drive head or lug that extends perpendicular (parallel to the handle) from the opposing side of the crank arm.

When in use, the drive head of the winch crank is inserted into the axially aligned socket formed within the winch drum. The winch crank is then rotated manually to rotate the winch drum which, which wrapped with rope, pulls and tightens the rope.

While winch cranks come in a wide variety of shapes, sizes and construction material, they all share drive heads having a standard size and shape in order to be received into winch drum sockets that all exhibit the same size and shape. By convention, winch crank drive heads demonstrate eight triangular splines that extend out laterally to exhibit an octagonal star shaped cross-section. The outside diameter of the drive head is approximately ⅞ inch whereas the diameter between splines is approximately ¾ inch. Conventional winches have a drum socket that is also octagonal star shaped in cross section with the same inside and outside dimension so that the winch crank drive fits snugly there within.

Depicted in FIG. 1 is a conventional winch handle or crank. Extending from the left bottom of winch handle shown in FIG. 1 is the drive head portion or lug 12 of the winch handle demonstrating the conventional octagonal star shape.

Beverages are frequently consumed aboard sailboats and those beverages are often bottled beverages having closures that comprise metal bottle caps, screw caps or other forms of closures. Most metal bottle caps need to be pried off with a bottle opener in order to access the bottle contents. Not uncommonly, the necessary bottle opener is forgotten, cannot be found, or is inconveniently stored somewhere within the boat cabin when needed above board. The winch handle or crank, on the other hand, is almost always to be found at the sailboat crew's finger tips as the handle is essential for trimming the sails and tightening other lines required for the proper operation of the sailboat.

A primary object of the present invention is to provide for a bottle closure that can be used for bottles containing beverages brought aboard sailing vessels that can be opened using tools already likely to be present aboard the vessel.

A further object of the present invention is to provide for a bottle closure that can be easily and conveniently opened using a conventional winch handle.

Other objects and advantages of the present invention will become apparent from the description and illustration of the invention as found herein.

SUMMARY OF THE INVENTION

These and other objects are accomplished through the subject invention, novel bottle closures designed to receive the drive head of a standard sized winch handle, and methods for making and using said bottle closures.

The bottle closures of the subject invention comprise a socket that exhibits an octagonal star shape, shaped and sized to receive the drive head of a conventional winch handle or crank. In other respects, the bottle closures of the subject invention function similarly to commercially available bottle closure. Such bottle closures comprise bottle caps that can be crimped or screwed onto the lip of the bottle, and closures that are screwed or otherwise secured within the inside the neck of a bottle.

One aspect of the present invention is to provide a closure for bottles that can be removed using the drive head of a conventional winch handle.

Another aspect of the present invention is to provide for a bottle cap that receives a standard sized winch handle.

Another aspect of the present invention is to provide for a bottle closures that received a standard sized winch handle that is secured inside the neck of a bottle.

Another aspect of the present invention is to provide a closure for bottles that can be removed using a conventional winch handle, easily, without damage to the bottle.

A further aspect of the present invention is to provide for a bottle cap that can receive and be rotated or levered using a winch crank of the type commonly found on sailing vessels.

Still yet another aspect of the present invention is to provide for a closure for bottles that can be opened by a conventional winch handle through the forces of rotating and/or prying or both.

DETAILED DESCRIPTION OF PREFERRED EMBODIMENTS

The instant invention is a means for closing bottles containing beverages, said closure means comprising a closure body, a socket formed in the top of said body accessible from above, and a closure means on the bottom of said body for closing and sealing the top of the bottle.

The socket formed in the top of the closure body is sized and shaped to received the lug of a conventional, standard sized, winch handle. The socket may be sufficiently deep to receive the entire length of the winch handle lug, or it may be shallower, to receive a partial length only of the distal portion of the winch handle lug.

The closure means on the bottom of said body for closing the top of the bottle may be a flange that extends out from the bottom of the body and that is affixed to the top of the bottle by crimping the flange around the lips of a bottle, as in the case of prior art pry-off bottle caps. Alternatively, the closure means on the bottom of said body for closing the top of the bottle may comprise a threaded flange that extends down from the bottom of the body and that is affixed to the top of the bottle by screwing down over threads present around the lip of the bottle bottom, as in the case of prior art screw-off bottle caps.

Alternatively, the closure means can be formed to be inserted into the neck of a bottle in the manner of a cork, and can be threaded to engage grooves formed along the inside of the bottle neck.

The novel closure means of the subject invention may be fabricated of metal, or plastic, or other materials, including composite materials, and may be fabricated from more than one material or composite material. The closure means can be fabricated in accordance with conventional methods including, by way of example, molding, stamping or extruding.

Bottles closed using the novel closure means of the subject invention are glass bottles, but can also include bottles made of other materials including, without limitation, plastic bottles. Such bottles will typically contain beverages of all sorts and variety but the novel closure means of the instant invention is expected to find greatest use in the case of bottled alcoholic beverages and, in particular, bottled beer, rum and other distilled drinks.

Winch Handle Operated Closure for Beer Style Bottles

Figure 1:
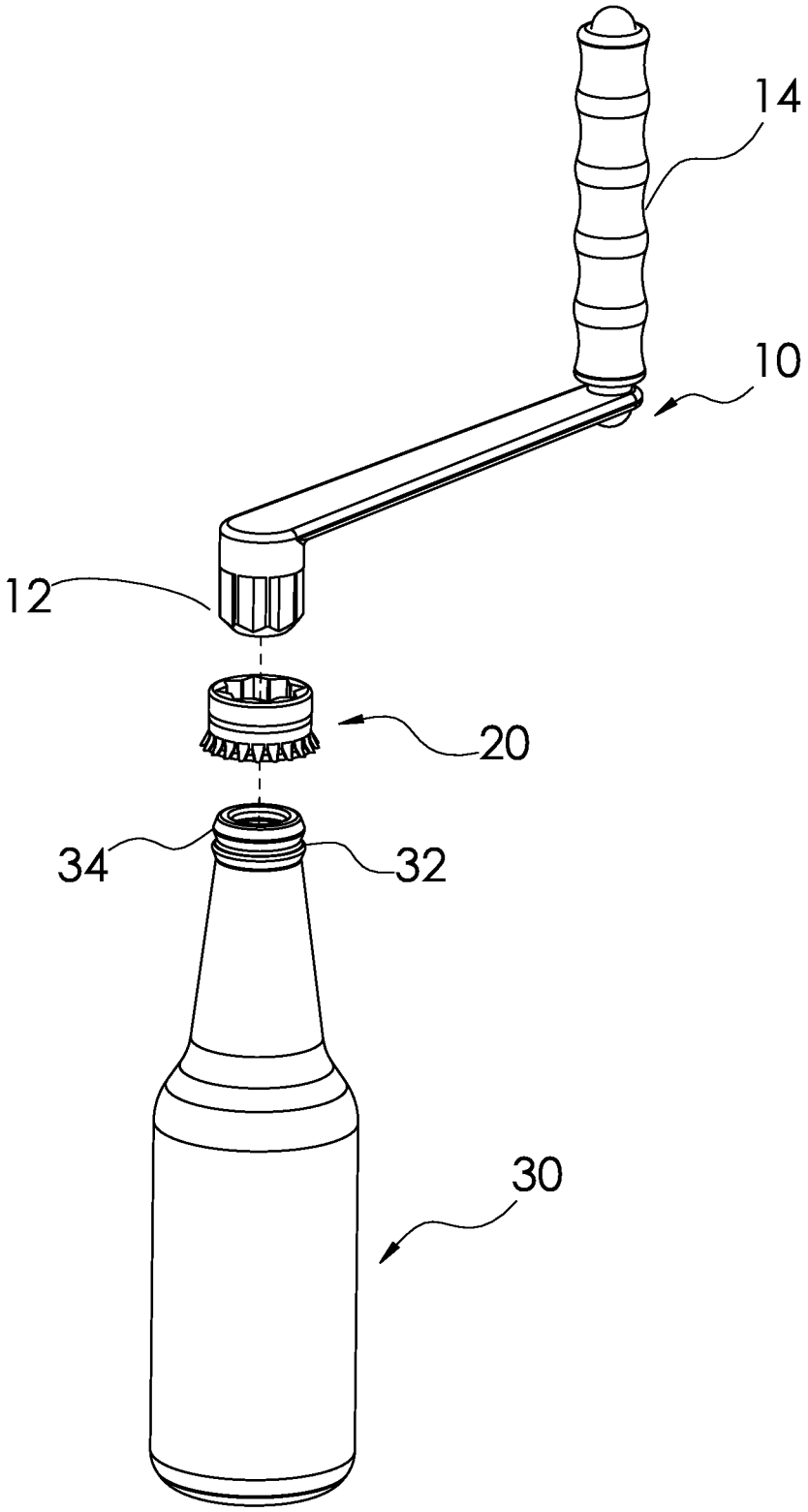
FIG. 1 illustrates in exploded view a conventional winch handle in relation to a novel bottle cap of the subject invention in relation to the bottle being capped and/or uncapped.
Figure 2:
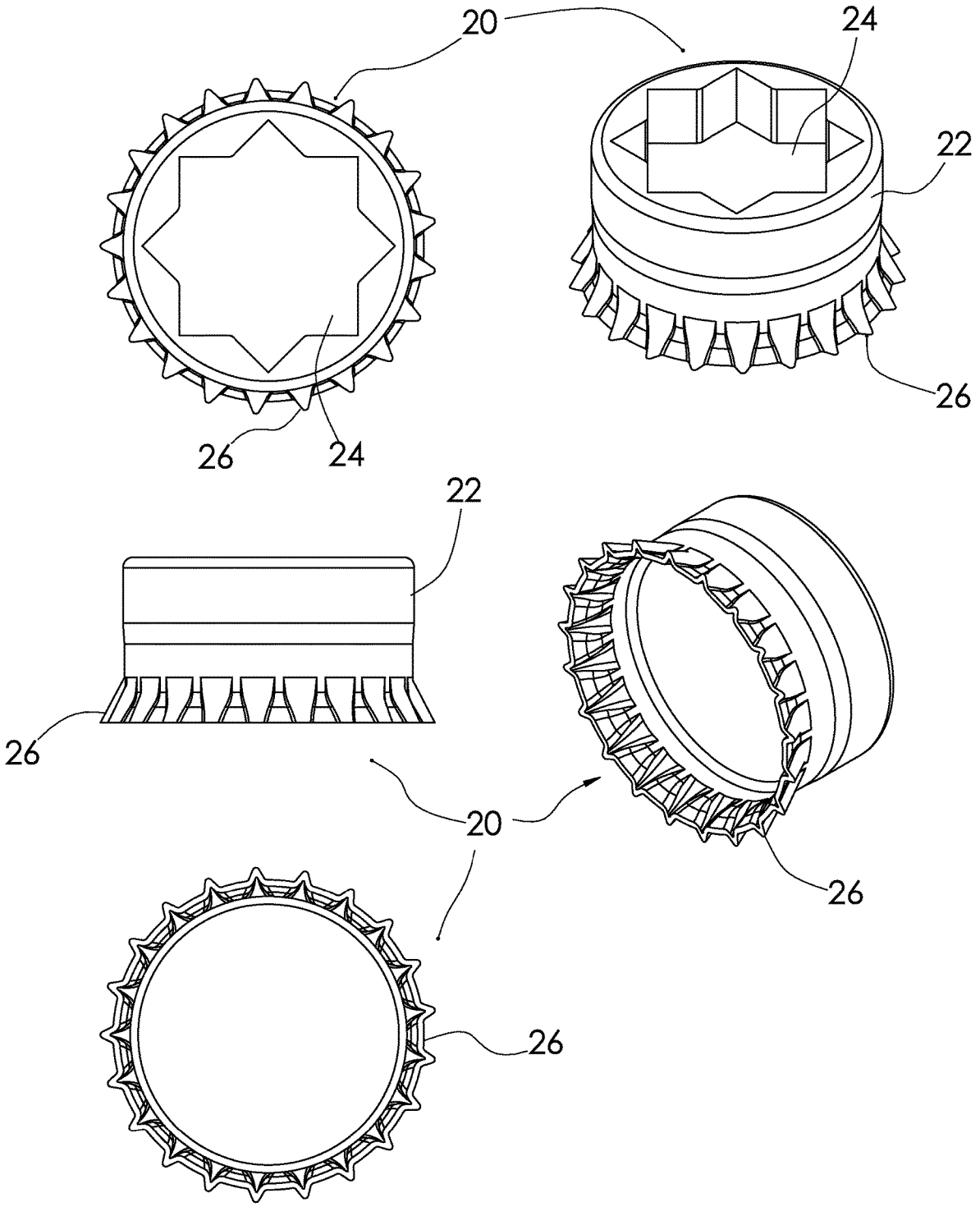
FIG. 2 depicts different views of one preferred embodiment of the novel bottle cap of the subject invention.

FIGS. 1 and 2 illustrate a first embodiment of the novel closure of the subject invention designed for use with beer style bottles.

Depicted in FIG. 1 in exploded view is a conventional winch handle 10 in relation to one preferred embodiment of the novel closure means 20 of the subject invention in relation to a bottle 30 to be closed. Extending downward from the bottom of the winch handle is a conventional, standard shaped and sized winch handle lug 12. Lug 12 demonstrates the conventional eight triangular-shaped splines that extend laterally out from the center of lug 12. When winch handle 10 is rotated, winch handle lug 12 also rotates.

The novel bottle closure 20 means illustrated in FIGS. 1 and 2 comprises a body 22, a socket 24 formed in the top of said body, and an flange 26 extending out and down from the bottom of said body exhibiting crimps. The bottle 30 illustrated in FIG. 1 has a horizontal lip 32 that receives a pry-off style bottle cap.

One embodiment of the novel closure means of the instant invention is illustrated in several view in FIG. 2. The preferred embodiment closure means exhibits a body 22 that is round and approximately the outside diameter of the neck 34 of the bottle that it caps. Formed in the top of the body is a socket 24 shaped and sized to receive the lug 12 or winch drive of a conventional winch handle 10. As such, the inside circumferences of socket 24 is formed by eight triangular shapes.

Along the bottom of the body of the preferred embodiment closure 20 illustrated in FIGS. 1 and 2 is a flange 26 that extends outward and downward and is shown formed with crimps. As illustrated, the bottom flange is un-crimped. In order to close bottle 30, bottom flange 26 is crimped over top lip 34 of bottle 30 such as the one illustrated in FIG. 1.

The manner of using the novel closure means illustrated in FIGS. 1 and 2 of the instant invention can best be understood by references again to FIG. 1. The bottle cap closure means 20 (illustrated also in FIG. 2) is closed over top lip 34 of bottle 30 by crimping bottle flange 26 of closure means 20 over the top lip of bottle 30. This seals bottle 30 and prevents fluid from entering or escaping in the same way as a prior art pry-off bottle and bottle cap.

To remove novel closure means 20 from bottle 30, lug 12 of conventional winch handle 10 is inserted into socket 24 formed in the top of bottle cap closure means 20 of the instant invention. Lug 12 demonstrates the conventional eight triangular-shaped splines to fit into socket 24 that exhibits a mirror image of the eight triangular-shaped splines of winch handle lug 12 such that socket 24 receives lug 12 precisely and snugly. Next, the handle portion 14 of winch handle 10 is grasped and handle 14 is rotated either clock-wise or counterclockwise, applying a torque force on closure means 20, removing bottle cap closure means 20 from bottle 30 rendering the contents of bottle 30 available for consumption.

Although rotation of winch handle 10 is one method for removing closure means 20 from bottle 30, winch handle 10 can, alternatively, be levered upwards, thereby applying a lateral force to closure means 20, prying closure means 20 off bottle 30. Still another method for removal of preferred embodiment closure means 20 illustrated in FIGS. 1 and 2 is to both rotate and lever winch handle 10, at the same time, applying simultaneously both a torque force and a lateral force to closure means 20, thereby facilitating the removal of bottle cap 20 from bottle 30.

Although bottle 30 illustrated in FIG. 1 has a pry-off type bottle top with single lip 32, the preferred embodiment closure means of the subject invention can also be used with a screw-type bottle that exhibits angled threads along its top portion. In the case of a screw top bottle, the method of opening would be mainly by way of rotating the winch handle and not levering the winch handle. Also, while prior art screw top bottles can sometimes be opened without the need for bottle openers or other tools, the novel closure means of the present invention will facilitate the easier opening of screw top bottles and the novel closure means can be affixed to screw top style bottles more firmly and securely than is the case with conventional screw top bottle caps so that they are not easily opened by hand, and require a tool such as a which handle to open.

Winch Handle Operated Closure for Rum and Whiskey Style Bottles

A second preferred embodiment of the novel bottle closure of the instant invention is described below and illustrated in FIGS. 3, 4 and 5.

Figure 3:
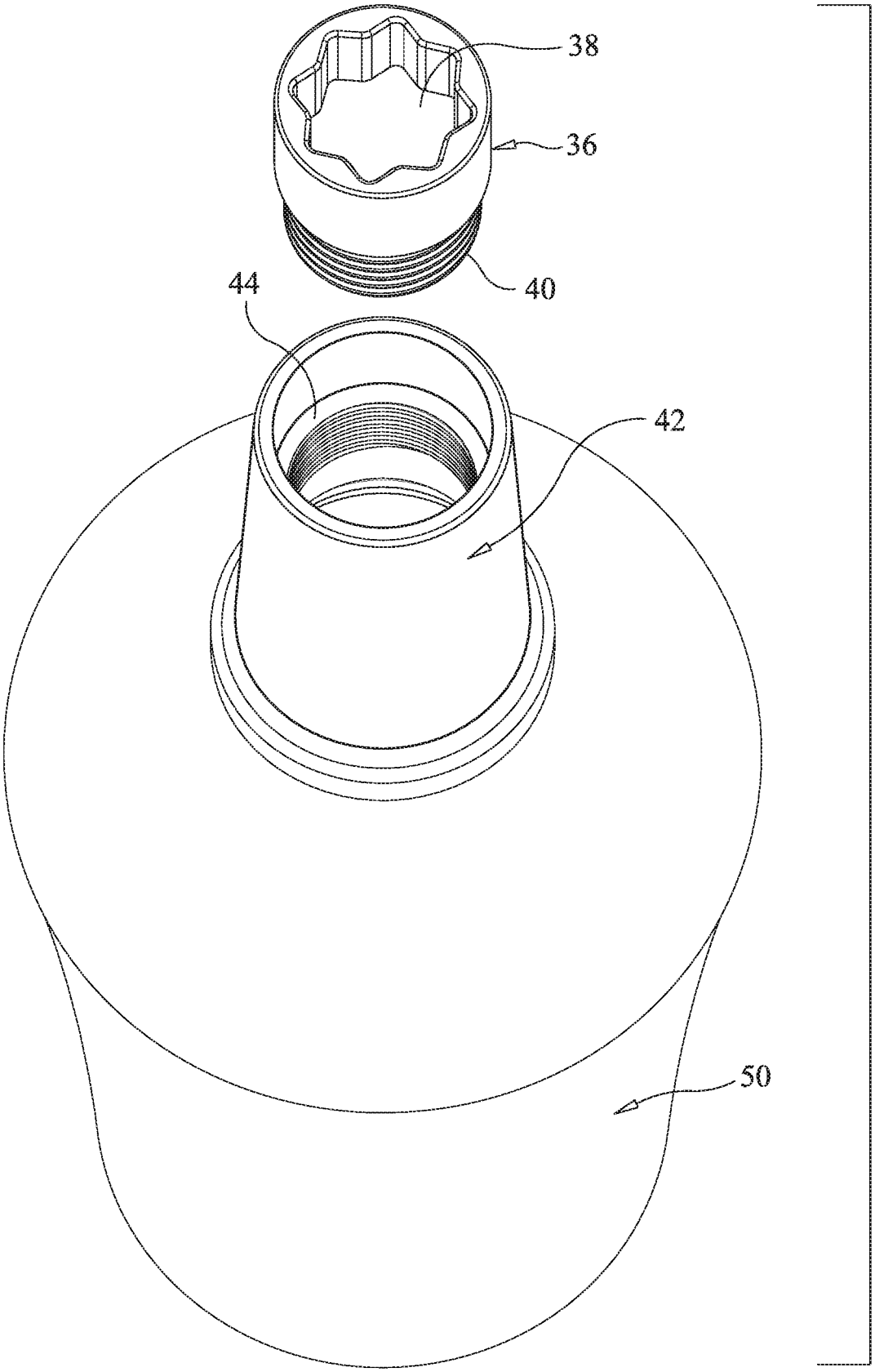
FIG. 3 a second embodiment of a bottle closure of the subject invention in relation to a bottle that is being capped and/or uncapped.

FIG. 3 shows a second embodiment closure 36 designed to be received into the neck of a rum or whiskey bottle 50.

Figure 4:
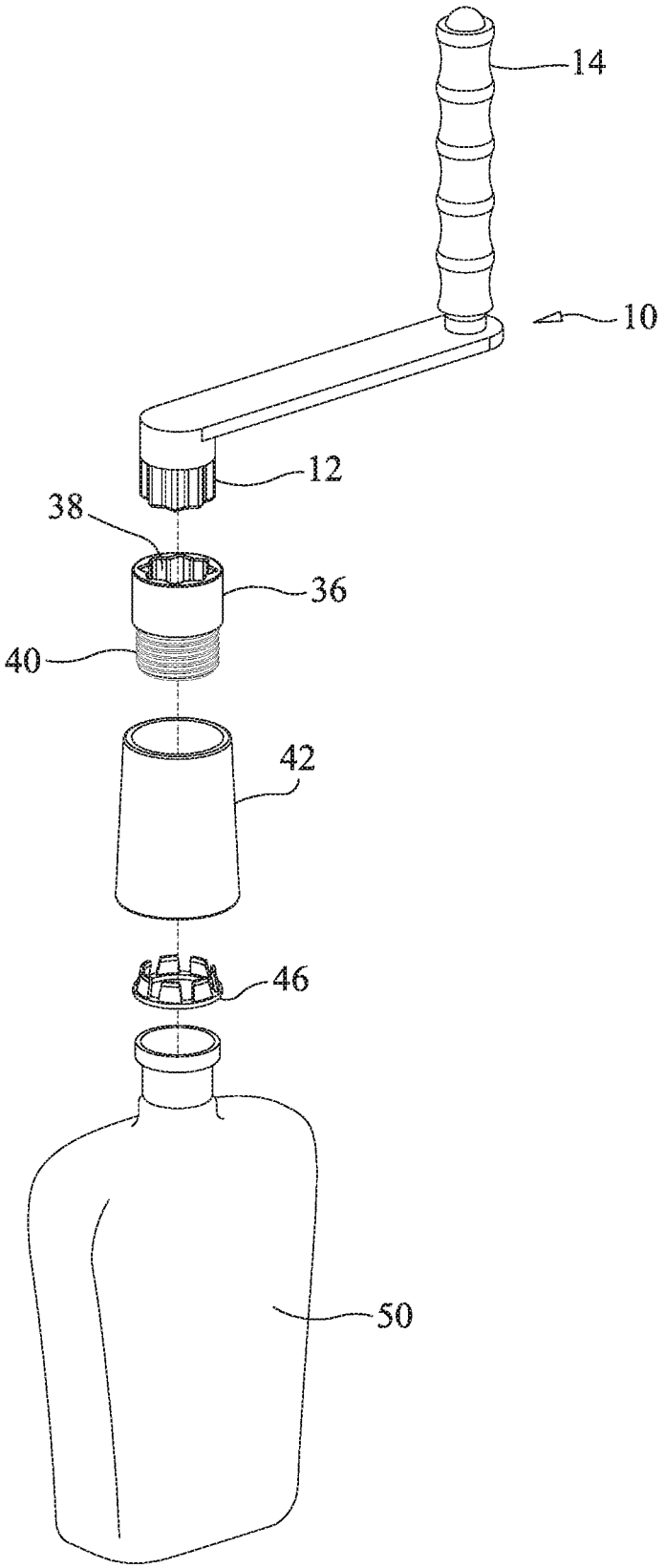
FIG. 4 illustrates in exploded view a conventional winch handle in relation to the second embodiment of the novel bottle closure of the subject invention in relation to the bottle being capped and/or uncapped.
Figure 5:
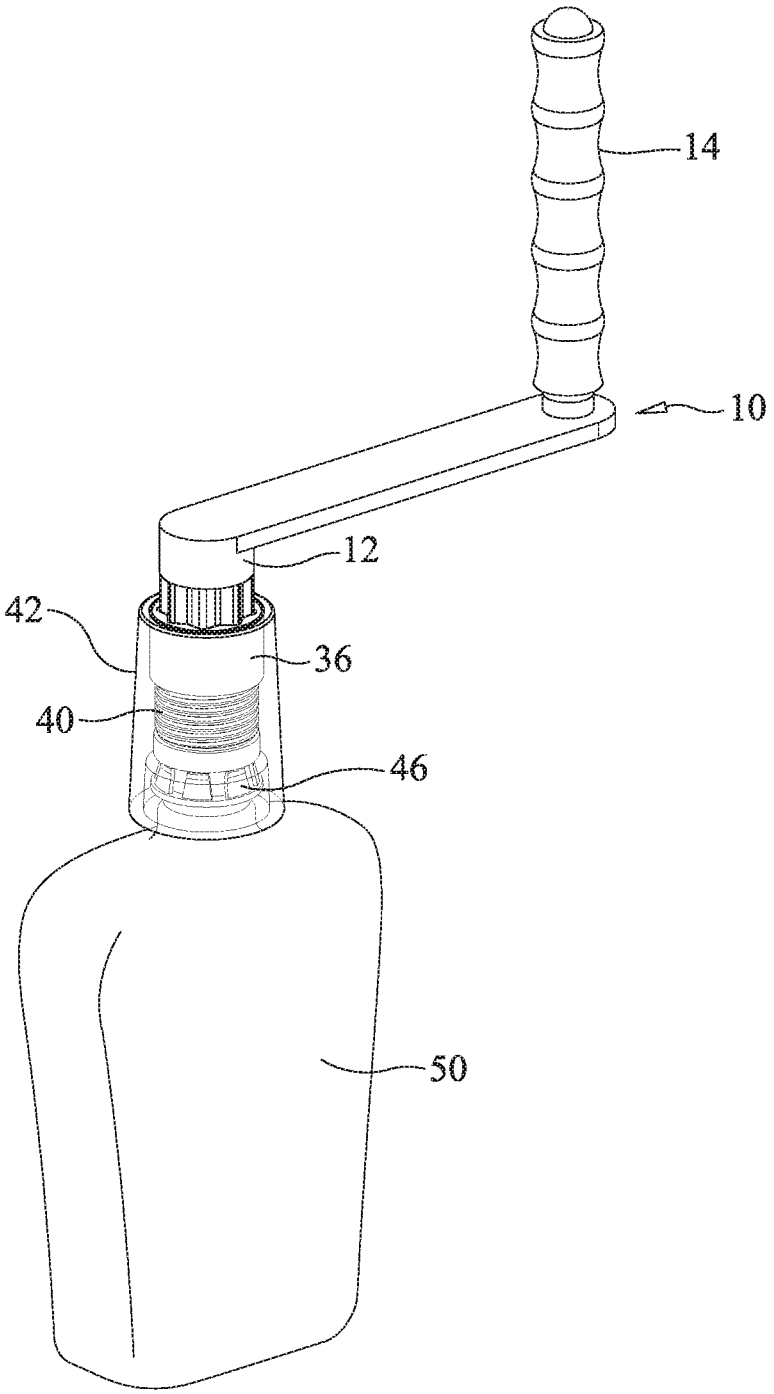
FIG. 5 further illustrates the second embodiment bottle closure showing a conventional winch handle engaged in the closure to cap or uncap the bottle.

Closure 36 demonstrates a socked 38 formed within its top surface shaped and sized to receive lug 14 of conventional winch handle 10 (shown in FIGS. 1,4 and 5). Threads 40 are formed around the circumference of closure 36. Closure 36 is received into a neck sheath 42 that surrounds the neck of bottle 50. A portion of the inside surface of sheath 42 demonstrates grooves 44 that receive the threads 40 formed along the circumference of closure 36.

Rum bottle closure 36 is depicted in FIGS. 4 and 5 in relation to conventional winch handle 10 and rum bottle 50.

FIGS. 4 (exploded view) and 5 (transparent view) also the manner that neck sheath 42 is secured to bottle 50. According to the particular rum bottle embodiment shown, bottle neck sheath 42 that receives closure 36 is permanently secured to the neck of bottle 50 using a locking means 46. Locking means 46 secures sheath 42 to the neck of bottle 50 in a manner that prevents sheath 42 from rotating around the neck of bottle 50 when closure 36 is rotated within sheath 42 using winch 10. This securement happens during the manufacturing process such that locking means 46 is not visible to the end user.

According to the embodiment shown in FIGS. 4 and 5, locking means 46 comprises a cincture having an irregular surface that engages a mirror image irregular surface formed along the inside of said sheath 42 thereby locking sheath 42 around the neck of bottle 50 while preventing sheath 42 from rotating around the neck of bottle 50 due to rotational forces from rotating closure 36 within sheath 42.

Referring to FIG. 5, rum bottle closure 36 is secured within the neck sheath 36 of rum bottle 50 to close or seal bottle 50 according to the following steps: (1) placing closure 35 over the opening formed in the neck of bottle 50; (2) inserting lug 12 of winch handle 10 into socket 38 of closure 36; (3) rotating handle 14 of winch handle 10 clockwise so that the threads 40 of closure 36 engage and move along the grooves 44 inside neck sheath 42 until closure 36 fully closes or seals bottle 50.

Conversely, and still referring to FIG. 5, rum bottle 50 is opened or unsealed by: (1) re-inserting lug 12 of winch handle 10 into socket 38 of closure 36; (3) rotating handle 14 of winch handle 10 counter-clockwise so that the threads 40 of closure 36 move along the grooves 44 inside neck sheath 42 until closure 36 is fully disengaged from neck sheath 42 and bottle 50.

Many commercially available winch handles are manufactured with locking plates extending from beneath the winch lug to prevent the winch handle from being pulled from the winch socket accidentally. The novel closure means the subject invention are easily modified to accommodate locking winch handles by modifying socket 24 of beer bottle closure 20, or rum bottle closure 36, to accommodate the locking plate together with lug 12.

SUMMARY AND SCOPE

As explained and illustrated above, the novel closures of the subject invention are closures that can receive the lug of a standard sized winch handle such that manipulation of the winch handle removes the closure from the bottle or other container.

The terms "a," "an," "the," and similar references used in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of any claim. No language in the specification should be construed as indicating any non-claimed element essential to the practice of the invention.

Certain embodiments are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventor intends for the invention to be practiced otherwise than specifically described herein.

For example, although not illustrated here but contemplated to be within the scope and spirit of the present invention are alternative embodiment closure means that receive a convention winch handle and by which the closure means are removed from bottles by levering or rotating while levering the winch handle. Such alternative embodiments include, but are not limited to, closure means wherein the rotation of the winch handle lug within the closure means socket serves to pull upwards and outwards the crimped bottle flange of the closure means to loosen and/or release the bottom flange from said bottle. Similarly, although the closures are illustrated with respect to beer and whiskey style bottles, the winch handle operated closures of the subject invention can also be applied to seal other types of containers.

Accordingly, the claims include all modifications and equivalents of the subject matter recited in the claims as permitted by applicable law. Moreover, any combination of the above-described elements in all possible variations thereof is contemplated unless otherwise indicated herein or otherwise clearly contradicted by context.

In closing, it is to be understood that the embodiments disclosed herein are illustrative of the principles of the claims. Other modifications that may be employed are within the scope of the claims. Thus, by way of example, but not of limitation, alternative embodiments may be utilized in accordance with the teachings herein. Accordingly, the claims are not limited to embodiments precisely as shown and described.

The invention claimed is:

1. A winch handle operated closure for containers having openings comprising:

(a) a socket formed within the upper surface of said closure, said socket sized and shaped to receive a conventional winch handle lug;

(b) a closure means integrated with the lower portion of said closure capable of sealing said container opening by rotating said closure about said opening;

wherein said closure means comprise threads along the outside surface of said closure that engage grooves on an inside surface of the container opening.

2. The closure of claim 1 wherein said closure is plug shaped with the said socket formed in the top thereof and threads formed about the outside of said plug.

3. The closure of claim 1 wherein the container is selected from a group consisting of rum bottles and whiskey bottles.

4. The closure of claim 1 wherein said winch handle lug demonstrates eight triangular-shaped splines extending laterally.

5. The closure of claim 1, wherein the socket has a depth equal to the length of said lug.

6. The closure of claim 1, wherein the socket has a depth that is less than the length of said lug.

7. A winch handle operated closure for containers having openings comprising:

(a) a socket formed within the upper surface of said closure, said socket sized and shaped to receive a conventional winch handle lug;

(b) a closure means integrated with the lower portion of said closure capable of sealing said container opening by rotating said closure about said opening;

(c) wherein the outside diameter of the lug is approximately ⅞ inch and the inside diameter of the lug is approximately ¾ inch.

8. A system for opening and closing containers with necks, comprising:

(a) a plug with socket formed within the upper surface thereof, said socket sized and shaped to receive a conventional winch handle lug, and threads formed about the outside surface of said plug;

(b) a sheath having an inside diameter sized to receive said plug with grooves formed along its inside surface to engage with the threads on the plug;

(c) wherein said sheath is secured to the neck of said container; and (d) said plug is screwed into and out of said sheath using a conventional winch handle.

9. The closure system of claim 8 further comprising a locking mechanism that fits between said container neck and sheath and that serves to secure said sheath onto said container neck in a manner that prevents said sheath from rotating around said neck when said plug is rotated within said sheath.

10. The closure system of claim 9 wherein said locking mechanism is a cincture having an irregular surface that engages a mirror image irregular surface formed along the inside of said sheath.

11. A method for opening and closing containers with openings, comprising the steps of:

(a) providing a container with grooves formed inside said container opening;

(b) providing a closure shaped to be screwed into and out of the said container opening with a socket formed within the upper surface of said closure, said socket sized and shaped to receive a conventional winch handle drive head and having a closure means integrated with the lower portion of said closure capable of sealing said container opening by rotating said closure about said opening;

(c) providing a winch handle with conventional drive head;

(d) inserting the drive head of said winch handle into said closure socket; and (e) rotating said closure means using said winch handle to open or close said container.

* * * * *